United States Patent [19]

Abel et al.

[11] 4,044,178

[45] Aug. 23, 1977

[54] PROCESS FOR REINFORCING NONWOVENS

[75] Inventors: Heinz Abel, Reinach; Rosemarie Toepfl, Basel; Luzius Schibler, Rhine, all of Switzerland

[73] Assignee: Ciba-Geigy Corporation, Ardsley, N.Y.

[21] Appl. No.: 648,430

[22] Filed: Jan. 12, 1976

Related U.S. Application Data

[63] Continuation of Ser. No. 275,117, July 26, 1972, abandoned.

[30] Foreign Application Priority Data

Aug. 4, 1971 Switzerland ..... 11473/71

[51] Int. Cl.[2] ..... B05D 3/02; B05D 1/18

[52] U.S. Cl. ..... 427/373; 427/386; 427/390 R; 427/430 R; 427/390 A; 260/47 EP; 260/78.41

[58] Field of Search ..... 427/386, 390 R, 394, 427/430 R, 373, 390 A; 260/47 EP, 78.41

[56] References Cited

U.S. PATENT DOCUMENTS 3,598,770 8/1971 Moore et al. ..... 260/2.5

FOREIGN PATENT DOCUMENTS 1,022,215 3/1966 United Kingdom ..... 427/386

*Primary Examiner*—Michael R. Lusignan

*Attorney, Agent, or Firm*—Karl F. Jorda; Edward McC. Roberts; Prabodh I. Almaula

[57] ABSTRACT

A process for reinforcing nonwovens by the foaming process accompanied by the use of binding agents and foaming assistants is provided. The nonwovens are treated with preparations which contain at least one binding agent and as foaming agents and a reactive surfactant which is converted into the irreversibly insoluble state at elevated temperature and thereby loses its surface activity. The treated nonwovens are then subjected to a heat treatment, time-consuming washing and rinsing procedures of the treated materials are not necessary.

19 Claims, No Drawings

PROCESS FOR REINFORCING NONWOVENS

This is a continuation of application Ser. No. 275,117, filed on July 26, 1972, now abandoned.

In the production of nonwovens a base of fibre (fleece) is manufactured initially. This fleece, however, does not have as yet any strength. It is consolidated by the application of binders, which may be done either in the spraypadding-pressure or foaming process. The advantage of the foaming process is that, on the one hand, about 50% air instead of water is applied, which leads to a rapid drying; and on the other hand, the punctiform deposit of the binder on the points of intersection of the fibres is promoted.

Besides the binder, large amounts of wetting agents are used according to known processes for reinforcing the fleece, but the disadvantage here is that the latter still has to be washed out after the drying. For this reason, the very interesting foaming process has hitherto been relatively little used.

In the known foaming process, the binder is initially diluted or emulsified with the requisite amount of water in a preparing vessel. The wetting agent is then added and the batch is very vigorously stirred in order that as much air as possible is brought in. As a rule, this step is not sufficient to bring in enough air and for this reason it is possible to bubble in additional air through fine jets or to add an aerating agent, e.g. sodium bicarbonate and acetic acid or azodicarbonamide, or so-called kickers, promoters or activators.

It has now been found that by using reactive surfactants instead of the conventional wetting agents it is possible to dispense with the expensive and time-consuming washing and rinsing procedures of the treated material which are necessary with the known processes.

The invention therefore provides a process for reinforcing nonwovens by means of the foaming process accompanied by the use of binders and foaming assistants, wherein these nonwovens are treated with preparations which contain at least one binder and, as foaming assistant, a reactive surfactant which is converted at elevated temperature into the irreversibly insoluble state and in the process loses its surface activity, and the thus treated nonwoven is then subjected to a heat treatment.

By surfactants are meant substances which are generally soluble in water or also in organic solvents and reduce the surface tension of the solvent; they are therefore active in the form of emulsifying or dispersing agents. Surfactant molecules contain both hydrophobic and hydrophilic groups and have the property of concentrating at phase interfaces (e.g. oil-water). If they are shaken with the solvent, they form voluminous and stable foams. In dilute solution these compounds are able to markedly reduce the surface tension of the solvent. Under certain circumstances, preferably in acid reaction or at elevated temperature, reactive surfactants also have a wetting capacity and this gives rise to the formation of insoluble, resin-like condensates which no longer possess surfactant properties. Surfactants of this kind with a particularly high rate of reactivity are derived from aminoplasts, preferably urea/formaldehyde or melamine/formaldehyde compounds, which are substituted with both hydrophobic and hydrophilic groups. Such reactive surfactants which are used according to the invention are known, e.g. from French Pat. Nos. 1,065,686; 1,470,103 and 1,581,989.

The reactive surfactants which are used according to the invention are preferably highly surface active aminoplast precondensates.

Particularly suitable reactive surfactants are aminoplast precondensates which contain methylol groups and a. radicals of monohydroxy compounds containing at least 4 carbon atoms and $b_1$. radical of an amine containing hydroxyl groups or $b_2$. radicals of a polyethylene glycol or $b_3$. radicals of an alcohol which contains at least 2 hydroxyl groups and radicals of Me—$O_3S$ groups which are bonded to carbon atoms, wherein Me represents an alkali metal atom or $b_4$. radicals of aliphatic hydroxycarboxylic acids which are bonded with the hydroxyl group to the aminoplast precondensate and, optionally, with an amine which contains hydroxyl groups.

By aminoplast precondensates, from which these reactive surfactants are derived, are meant addition products of formaldehyde with metholylatable nitrogen compounds. The following may be cited here as aminoplast formers: 1,3,5-aminotriazines, such as N-substituted melamines, e.g. N-butylmelamine, N-trihalogenomethylmelamines, also ammeline, guanamines, e.g. benzoguanamine, acetoguanamine or also diguanamines. Also suitable are alkyl or aryl ureas and thioureas, alkylene ureas or diureas, e.g. ethylene urea, propylene urea, acetylene diurea or 4,5-dihydroxyimidazolid-2-one and derivatives thereof, e.g. 4,5-dihydroxyimidazolid-2-one which is substituted in 4-position at the hydroxyl group by the radical —$CH_2CH_2$-CO—NH—$CH_2$—OH. Preferably the methylol compounds of urea and melamine are used. In general, products which are as highly methylolated as possible yield particularly valuable products. Suitable starting products are both the preponderantly monomolecular and higher precondensed compounds. The aminoplast precondensates which are used as starting products for the manufacture of the reactive surfactants may also be ethers of alkanols containing from 1 to 3 carbon atoms, particularly methyl ethers.

Accordingly, the use of highly surface active, etherified methylalmelamines or methylol ureas as reactive surfactants is preferred.

The great number of reactive surfactants which are suitable for the process according to the invention include non-ionic, anionic and cationic surfactants.

Particularly suitable non-ionic reactive surfactants are e.g. hardenable aminoplast precondensates which contain etherified methylol groups and whose methylol groups are etherified partly with hydroxy compounds of the formula $$HO-(CH_2-CH_2-O-)_n-H, \quad (1a)$$

wherein $n$ represents an integer from 2 to 115 partly with a monoalcohol containing from 4 to 18 carbon atoms.

Compounds of the formula (a) are preferably polyethylene glycols. The monoalcohols are, e.g. amyl alcohols, hexanol-(1), 2-ethylbutanol-(1), dodecanol, benzyl alcohol, stearyl alcohol or, primarily, n-butanol.

As reactive surfactants, particular interest attaches to cutable ethers of methylol ureas or methylol melamines, whose methylol groups are etherified partly with a polyethylene glycol with an average molecular weight of 1000 to 5000 and partly with an alkanol containing from 4 to 7 carbon atoms. Reaction surfactants of this kind are described in French Pat. No. 1,381,811.

Non-ionic reactive surfactants, which are likewise suitable, are low molecular, preferably monomer reactive surfactants from carbamides. They are obtained by etherifying the monomethylol compound of a carbamide with a hydrophobic or hydrophilic hydroxy compound, then introducing a second methylol group by reaction with formaldehyde or a formaldehyde donor, and subsequently etherifying this second methylol group with a hydrophobic or hydrophilic hydroxyl compound in such a way that, at the conclusion, the molecule of the reactive surfactant contains at least one hydrophobic and one hydrophilic group.

Suitable low molecular reactive surfactants are derived from the monomethylol compounds of acyclic ureas, in particular from monomethylol ureas.

These reactive surfactants are obtained, for example, by reacting a compound of the formula $$H_2N - CO - NH - CH_2 - O - R, \quad (1b)$$

wherein R represents alkyl or alkenyl containing from 6 to 22 carbon atoms, alkylcyclohexyl or alkylphenyl containing from 2 to 12, preferably 6 to 10 carbon atoms in the alkyl radical, or cycloalkyl containing from 8 to 12 ring carbon atoms, with formaldehyde or a formaldehyde donor, and subsequently etherifying the reaction product with a polyalkylene glycol having an average molecular weight of at most 2000, preferably between 106 and about 1200.

Preferably, R is alkyl or alkenyl containing from 6 to 22, in particular from 10 to 18 carbon atoms.

As reactive anionic surfactants there are used, for example, aminoplast precondensates which contain etherified methylol groups and whose methylol groups are reacted partly with monohydroxy compounds containing at least 4 carbon atoms, and partly with alcohols containing at least two hydroxyl groups, and which contain $Me—O_3S$ groups, wherein Me represents an alkali metal atom. Me may also thus be a sodium, potassium or lithium atom. Particularly suitable surfactants of this kind are chiefly etherified methylol ureas or methylol melamines whose methylol groups are etherified partly with alkanols which contain from 4 to 18 carbon atoms, and partly with alcohols of the formula $H—(O—CH_2—CH_2)_m-OH$, wherein $m$ represents an integer of at most 25, and which contain $Me—O_3S$ groups which are bonded to carbon atoms, wherein Me represents an alkali metal atom. Such anionic reactive surfactants are known from French Pat. No. 1,470,103.

Other interesting anionic reactive surfactants are, for example, aminoplast precondensates which contain etherified methylol groups and whose methylol groups are etherified partly with monohydroxy compounds which contain from 4 to 22 carbon atoms, partly with aliphatic hydroxycarboxylic acids which contain from 2 to 4 carbon atoms, and, optionally, partly with an alkanolamine which contains from 2 to 6 carbon atoms. Particularly preferred among these reactive surfactants are etherified methylol ureas or methylol melamine whose methylol groups are etherified partly with alkanols which contain from 4 1 to 22 carbon atoms, partly with saturated hydroxylcarboxylic acids which contain from 2 to 5 carbon atoms, and, optionally, partly with ethanol-, diethanol- or triethanolamine. Anionic reactive surfactants of this kind are described in French Pat. No. 1,065,686.

The anionic and cationic reactive surfactants are preferred to the non-ionic surfactants.

The process according to the invention is carried out preferably in aqueous medium; but it is also possible to carry it out in organic solvents, preferably solvents which are miscible with water, such as alcohols, glycols etc., or in mixtures of water and solvent.

In the process according to the invention, it is possible to initiate and carry through the conversion of the reactive surfactants into the irreversibly insoluble state by various means, among which particular mention may be made of raising the temperature, adjusting certain pH values, adding substances which react with the surfactants or aminoplast precondensates accompanied by the formation of high molecular products, and, above all, adding curing catalysts which display acid reaction.

If the reinforcing is carried out in aqueous medium, the pH of the preparation is advantageously 2 to 4.5, preferably 2.8 to 3.5. Principally, aliphatic low molecular carboxylic acids, such as formic, acetic or citric acid, or inorganic acids such as hydrochloric or phosphoric acid, also acid or hydrolysable salt such as aluminium sulphate, titanium oxychloride, megnesium chloride, ammonium salts of strong acids, such as ammonium chloride, nitrate, sulphate or dihydrogen phosphate, are suitable for adjusting the pH. Also suitable are oxidants which can oxidise formaldehyde to formic acid, such as hydrogen peroxide. However, the use of volatile acids has proved most appropriate of all.

As examples of suitable binders there may be mentioned: acrylic resins, butadiene/styrene, butadiene/acrylonitrile/styrene, butadiene/acrylonitrile, melamine resins, epoxide resins, polyester resins, polyurethane, phenol resins, polyvinyl acetate, polyvinyl alcohol, polyvinyl chloride, natural latex, and, in particular, epoxide reaction products.

As binding agents, particular interest attaches to reaction products of epoxides and fatty amines with basic polyamides or dicarboxylic acids.

Suitable reaction products of epoxides, fatty amines and basic polyamines are obtained by reacting, in the presence of an organic solvent at temperatures of up to 95° C, a reaction product of at least a. an epoxide which contains at least 2 epoxide groups per molecule, and b. at least one higher molecular fatty amine, wherein the equivalent ratio of epoxide groups to amino groups is 1:0.1 to 1:0.85, with a basic polyamide which is obtained by condensing c. polymeric, unsaturated fatty acids and c'. polyalkylene polyamines, wherein the equivalent ratio of epoxide groups of the reaction product of components (a) and (b) to amino groups of the basic polyamide of the components (c) and (c') is 1:1 to 1:6, preferably 1:1 to 1:5, and, by addition of acid at the latest upon completion of the reaction, ensuring that a sample of the reaction mixture present in the organic medium has a pH of 2 to 8 after addition of water.

The amine equivalent is to be understood as indicating the amount of polyamide in grams which is equivalent to one mole of monoamine.

Also suitable are reaction products of epoxides, fatty amines and dicarboxylic acids, wherein at least a. an epoxide which contains at least 2 epoxide groups per molecule, b. a higher molecular fatty amine and $c_1$. an aliphatic, saturated dicarboxylic acid containing at least 7 carbon atoms and, optionally, $c_2$. an anhydride of an aromatic dicarboxylic acid containing at least 8 carbon atoms or of an aliphatic di- or monocarboxylic acid containing at least 4 carbon atoms, and optionally one or more of the following components:

d. an aminoplast precondensate which contains an alkyl ether group, e. an aliphatic diol containing from 2 to 22 carbon atoms, and f. a polyfunctional preferably difunctional, organic compound which possesses as functional groups or atoms, mobile halogen, vinyl or ester groups, or at most one acid, nitrile, hydroxyl or epoxide group together with at least one other functional group or an atom of the indicated kind, are reactesd with one another to give a reaction product which contains free carboxyl groups, and then, optionally at elevated temperature, treating said reaction product optionally with g. ammonia or a water soluble, organic base, in particular aliphatic tertiary monoamines or polyamines, and, optionally by addition of further ammonia or further water soluble organic bases, ensuring that a sample of the reaction mixture present in the organic medium has a pH of 7.5 to 12 after dilution with water.

The epoxides of the component (a) are derived preferably from polyvalent phenols or polyphenols, such as resorcinol, phenol/formaldehyde condensation products of the type of the resols or novolaks. Preferred starting compounds for the manufacture of the epoxides are in particular bisphenols, such as bis-(4-hydroxyphenyl)-methane, and, above all, 2,2-bis-(4'-hydroxyphenyl)-propane.

Particular mention may be made here of epoxides of 2,2-bis(4'-hydroxyphenyl)-propane which have an epoxide content of 1.8 to 5.8 epoxy group equivalents/kg, but preferably have at least 5 epoxy group equivalents/kg and correspond to the formula

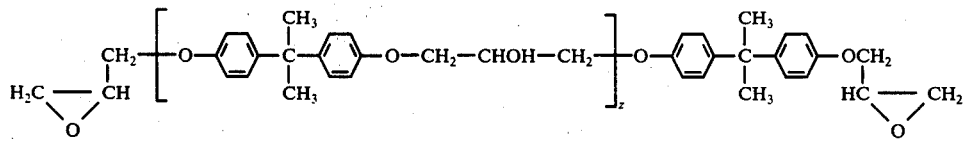

(2)

wherein $z$ represents a mean number having a value from 0 to 0.65. Such epoxides are obtained by reacting epichlorohydrin with 2,2-bis-(4'-hydroxyphenyl)-propane.

Mono-fatty amines containing from 12 to 22 carbon atoms have above all proved to be very suitable components (b). As a rule, these are amines of the formula $$H_3C - (CH_2)_x - NH_2, \quad (3)$$

wherein $x$ represents an integer having a value from 11 to 21, preferably from 17 to 21. The amines are therefore, for example, laurylamine, palmitylamine, stearylamine, arachidylamine or behenylamine. Mixtures of such amines obtainable in the form of commercial products are also possible.

The ratio of epoxides (a) to amines (b) is so chosen that an excess of epoxides is used, so that more than one epoxide group is provided for every amino group.

According to the invention, the amount of the components (a) and (b) is to be so determined that there is an equivalent ratio of 1 epoxide group to 0.1 to 0.5 amino groups, i.e. the amount of epoxide which corresponds to one epoxide group equivalent is reacted with the amount of amine which corresponds to an amino group equivalent of 0.1 to 0.5. The equivalent ratio of epoxide groups to amino groups is preferably 1:0 to 1:0.5, or especially 1:0.25 to 1:0.5.

The reaction of component (a) with component (b) takes place advantageously at 80° to 120° C, preferably 100° C.

The polymer unsaturated fatty acids which are used as component (c) for the manufacture of the basic polyamides are preferably aliphatic, ethylenically unsaturated dimeric to trimeric fatty acids. The reaction products are manufactured preferably from the polyalkylene polyamines (c') and aliphatic unsaturated dimeric to trimeric fatty acids (c), which are derived from monocarboxylic acids containing from 16 to 22 carbon atoms. These monocarboxylic acids are fatty acids with at least one, preferably 2 to 5, ethylenically unsaturated bonds. Representatives of this class of acids are e.g. oleic acid, hiragonic acid, eleostearic acid, licanic acid, arachidonic acid, clupanodonic acid and especially linoleic and lonoleic acid. These fatty acids may be obtained from natural oils, in which they occur as glycerides.

The dimeric to trimeric fatty acids (c) are obtained in known manner by dimerisation of monocarboxylic acids of the indicated kind. The so-called dimeric fatty acids always contain some trimeric acids and a small amount of monomeric acids.

Particularly suitable for use as component (c) are the dimerised to trimerised linoleic or linolenic acids. The commercial products of these acids contain as a rule 75 to 95 percent by weight of dimeric acid, 4 to 25 percent by weight of trimeric acid and a trace to 3% of monomeric acid. The molar ratio of dimeric to trimeric acid is accordingly about 5:1 to 36:1.

Suitable components (c') are chiefly polyamines, such as diethylenetriamine, triethylenetetramine or tetraethylenepentamine, i.e. amines of the formula $$H_2N - (CH_2\text{-}CH_2\text{-}NH)_n - CH_2 - CH_2 - NH_2, \quad (4)$$

wherein $n$ is 1, 2 or 3.

In the case of amine mixtures, it is also possible to adopt a non-integral mean number, e.g. between 1 and 2.

As a component of particular interest there is used a basic polyamide of dimerised to trimerised linoleic or linolenic acid and a polyamine of the formula (4).

Suitable organic solvents in the presence of which the reaction of the individual components takes place are primarily water soluble organic solvents, and advantageously those which are miscible with water. As examples there may be cited: dioxan, isopropanol, ethanol and methanol, ethylene glycol-n-butyl-ether (=n-butylglycol), diethylene glycol monobutyl ether.

It is also possible, moreover, to carry out the reaction in the presence of water insoluble organic solvents, e.g. in petroleum hydrocarbons, such as petroleum or petroleum ether, benzene, halogenated benzenes or benzenes which are substituted by lower alkyl groups, such as toluene, xylene, chlorobenzene; alicyclic compounds, such as tetralin or cyclohexane; halogenated hydrocarbons, such as methylene chloride, methylene bromide, chloroform, carbon tetrachloride, ethylene chloride, ethylene bromide, s-tetrachloroethane, and above all, trichloroethylene or perchloroethylene.

The reaction products of epoxide-fatty amine and polyamide may optionally also be obtained with the conjoint use of a third component (w), namely a further mono- or bifunctional compound which is different from the first. These mono- or bifunctional compounds contain as functional groups or atoms mobile halogen atoms, vinyl, acid, ester, acid anhydride, isocyanate or epoxide groups. Of the monofunctional compound (w), advantageously about 0.25 mole is used for one amino group equivalent of the polyamide; but this content can also be raised to e.g. 0.5 mole per amino group equivalent. Of bifunctional compounds, preferably 0.05 to 0.5 mole is used for one amino group equivalent of the polyamide.

These components (w) are preferably aralkyl or alkyl halides, nitriles, amides or methylolamides of acids of the acrylic acid series, aliphatic or aromatic carboxylic acids, their esters or anhydrides, and aliphatic or aromatic isocyanates, epoxides or epihalogenohydrins.

As monofunctional components (w) there are advantageously used alkyl halides such as ethyl bromide or butyl chloride, aralkyl halides such as benzyl chloride; nitriles, amides or methylolamides of acrylic or methacrylic acid, e.g. acrylonitrile, acrylic amide or N-methylolacrylic amide. Instead of methylolacrylic amide, it is also possible to use a mixture consisting of acrylic amide and formaldehyde or a formaldehyde donor, with the N-methylolacrylic amide being formed in situ. Alkanecarboxylic acids of up to 18 carbon atoms, such as coconut fatty acid or stearic acid, or esters thereof with alkanols, which contain at most 5 carbon atoms, e.g. methanol, ethanol or n-butanol, or their anhydrides such as acetic anhydride, aromatic isocyanates, such as phenylisocyanate, or aliphatic or aromatic epoxides, such as propylene oxide, butylene oxide, dodecene oxide or styrene oxide, may also be used.

Particularly suitable compounds (w) are alkylene oxides of at most 12 carbon atoms, alkanecarboxylic acids of at most 18 carbon atoms, monocyclic aralkyl halides or acrylonitrile.

The sequence in which the reaction of the polyamides with the monofunctional compounds and epoxide-fatty amide reaction products takes place is of secondary importance. The polyamides can first be reacted with a monofunctional compound and then with the epoxide-fatty amine reaction product, or vice versa. If there are no great differences in the reactivity, it is also possible in many cases to carry out the reaction simultaneously.

The reaction to give the reaction product of components (a) and (b) with (c) and (c') is carried out in such a way that polyaddition products which are soluble or dispersible in water are formed by adjusting the pH—at the latest upon completion of the reaction—to 2 to 8, preferably 2 to 7, but especially 5 to 6. This pH value is adjusted by using, for example, inorganic or organic acids, advantageously readily volatile organic acids, such as formic or acetic acid. Immediately, or shortly after, the basic polyamide has begun to combine with the epoxide, it is advisable to add a certain amount of acid, and also to add more acid during the further course of the reaction continuously or in small amounts. Furthermore, the process is carried out preferably at temperatures of up to 80° C, consequently, for example, from 25° to 80° C, especially 40° to 70° C. The resulting solutions or dispersions—in most instances faintly opalescent to turbid solutions—which have been adjusted with acid to the indicated pH value and appropriately adjusted with an organic solvent or preferably with water to a content of 10 to 40%, especially 10 to 30% of reaction product, are distinguished by high stability.

Products with advantageous properties are also obtained if, after the addition of the acid and the water, the preparations is then stored at room temperature, e.g. for 4 hours at 70° C, or a longer period of time at lower temperature.

Alkylenedicarboxylic acids containing from 7 to 14 carbon atoms have all proved advantageous components ($c_1$). As a rule, these are dicarboxylic acids of the formula $$HOOC-(CH_2)_y-COOH \quad (5)$$

wherein $y$ represents an integer having a value of 5 to 12, preferably 6 to 10.

Accordingly, possible components ($c_1$) are, for example, dicarboxylic acids, such as pimelic, suberic, azelaic or sebacic acid, nonanedicarboxylic acid, decanedicarboxylic acid, undecanedicarboxylic acid or dodecanedicarboxylic acid.

The components ($c_1$) can be employed alone or together with the component ($c_2$). As the components ($c_2$), an anhydride of a monocyclic or bicyclic aromatic dicarboxylic acid with 8 to 12 carbon atoms or of an aliphatic dicarboxylic acid with 4 to 10 carbon atoms is preferably used. Anhydrides of a monocyclic aromatic dicarboxylic acid containing from 8 to 10 carbon atoms have proved particularly advantageous. Optionally methyl-substituted phthalic anhydride is of particular interest.

Accordingly, suitable components ($c_2$) are anhydrides, for example, maleic anhydride or phthalic anhydride.

Where the component (d) is used conjointly for the manufacture of the reaction products, its proportion, relative to the total of the components (a), (b), ($c_1$) and (d), is 10 to 90, especially 4 to 70, percent by weight.

The aminoplast condensates used as component (d) are completely etherified, or especially partially etherified, methylol compounds of nitrogen-containing aminoplast formers, such as urea, urea derivatives, for example ethyleneurea, propyleneurea or glyoxalmonourein.

Preferably, however, etherified methylolaminotriazines are employed, for example, alkyl ethers of highly methylolated melamine, whose alkyl radicals contain from 1 to 4 carbon atoms. Possible alkyl radicals include, methyl, ethyl, n-propyl, isopropyl, n-butyl and n-hexyl radicals. In addition to such alkyl radicals, yet further radicals, for example polyglycol radicals, may also be present in the molecule. Furthermore, n-butyl ethers of a highly methylolated melamine, which contain 2 to 3 n-butyl groups in the molecule, are preferred. By highly methylolated melamines are meant here those with an average of at least 5, appropriately about 5.5, methylol groups.

If component (e) is conjointly used for the manufacture of the reaction products, these diols are preferably aliphatic diols containing from 2 to 6 carbon atoms, and whose carbon chains are optionally interrupted by oxygen atoms. Alkylenediols with 2 to 6 carbon atoms or diethylene glycol or triethylene glycol are of particular interest. Of the alkylenediols containing from 2 to 6 carbon atoms which are particularly advantageously used, ethylene glycol, 1,4-butanediol or above all 1,6-hexanediol may, for example, be mentioned.

The optional, polyfunctional, preferably difunctional, component (f) preferably contains, as functional groups or atoms, alkyl-bonded halogen atoms, vinyl or carboxylic acid ester groups, or at most one epoxide, carboxylic acid or hydroxyl group together with another functional group or another atom of the indicated type. In particular, these compounds are difunctional organic compounds which contain as functional groups or atoms, alkyl-bonded chlorine or bromine atoms, vinyl or carboxylic acid alkyl ester groups or at most one epoxide or carboxylic acid group together with another functional group or another atom of the indicated type.

Particularly suitable difunctional organic compounds are aliphatic. These are, for example, epihalogenohydrins, such as epibromohydrin or above all epichlorohydrin.

Other possible difunctional compounds are, for example, glycerine-dichlorohydrin, acrylic acid, methylolacrylamide and acrylonitrile.

The component (g) is advantageously an aliphatic tertiary monoamine, ammonia or an amine containing at least two amino groups and exclusively basic nitrogen atoms, wherein the amino groups possess at least one nitrogen-bonded hydrogen atom.

Preferred tertiary amines are trialkylamines containing from 3 to 12 carbon atoms, for example triethylamine, tri-n-propylamine or tri-n-butylamine.

The diamines to be used as component (g) may be aliphatic or cycloaliphatic and preferably possess at least one primary amino group and a second amino group, wherein at least one hydrogen atom is bonded to nitrogen. Furthermore, just ammonia can also be used as component (g). However, diprimary aliphatic or cycloaliphatic amines are preferentially used as the component (g).

Suitable aliphatic amines are here above all polyamines, such as diethylenetriamine, triethylenetetramine or tetraethylenepentamine, that is to say amines of the formula $$H_2N-(CH_2-CH_2-NH)_n-CH_2-CH_2-NH_2 \quad (6)$$

wherein $n$ is 1, 2 or 3.

In the case of amine mixtures, a non-integral average value can also be assumed, for example between 1 and 2.

Suitable cycloaliphtic amines are above all diprimary, cycloaliphatic diamines, which desides the two amine nitrogen atoms contain only carbon and hydrogen, and which possess a saturated 5-membered to 6-membered carbocyclic ring, a $H_2N-$ group bonded to a ring carbon atom and a $H_2N-CH_2-$ group bonded to another ring carbon atom.

As examples of such amines, 3,5,5-trimethyl-1-amino-3-aminomethyl-cyclohexane or 1-amino-2-aminomethyl-cyclopentane may be mentioned.

The manufacture of the reaction products can be carried out according to methods which are known, in the art, wherein the components can be reacted with one another in varying sequence. Appropriately, components (a) and (b), or (a), (b) and ($c_1$) are first reacted with one another. The reaction of the component ($c_1$) with the already reacted components (a) and (b) can also take place simultaneously with component (e). The reaction with the components (d) and/or (f) is as a rule only carried out at the end, that is to say before the reaction with the component (g).

On the one hand, it is thus possible initially to react the components (a), (b) and ($c_1$) and optionally ($c_2$), simultaneously with one another, and subsequently optionally to react the product with the components (d), (e) and (f). In this process variant the components (a), (b) and ($c_1$) are appropriately reacted with one another at temperatures of 80° to 120° C, preferably 100° C, with the proportions being advantageously so chosen that for an epoxide group equivalent of 1, the equivalent ratio of hydrogen bonded to amine nitrogen to carboxylic acid groups is 0.1:1 to 1:0.55.

On the other hand, it is also possible first to react only the components (a) and (b) with one another and subsequently to react the products with the component ($c_1$) and, optionally, in third stage with the components (d), (e) or (f). The manufacture of the reaction products from (a) and (b) is, according to this second variant, also appropriately carried out at temperatures of 80° to 120° C, preferably at about 100° C. The reaction in the second stage, with the component ($c_1$), appropriately takes place at 80° to 110° C, preferably at about 100° C, with the proportions being advantageously so chosen that for an epoxide group equivalent of 1, the equivalent ratio of hydrogen bonded to amine nitrogen to carboxylic acid groups is 0.1:1 to 1:0.55.

The ratio of epoxide (a) to fatty amine (b) and acid ($c_1$) or anhydride ($c_2$) is so chosen, according to the invention, that a less than equivalent amount of epoxide is used, so that there is fewer than one epoxide group per sum of the amino and acid groups. The raction products thus contain carboxyl end groups.

The reaction product containing carboxylic acid groups as a rule has an acid number of 5 to 80, preferably 35 to 60.

The reaction with the component (d) is as a rule carried out at temperatures of 60° to 105° C, preferably at about 100° C. In most cases, this reaction takes place in the presence of small amounts of organic solvent, for example, n-butanol.

The reaction with the component (e) takes place, as already mentioned, simultaneously with that of component ($c_1$).

The reaction with the component (f) takes place before the treatment with component (g) at temperatures of about 60° to 120° C.

The treatment with the component (g) can take place at room temperature of elevated temperature, so that either merely a neutralisation, with salt formation, occurs, or, provided tertiary amines are not used, a true reaction takes place. In both cases, however, polyaddition products which are soluble or dispersible in water are produced by ensuring that, upon completion of the reaction at the latest, if necessary by adding a base, a sample of the reaction mixture diluted with water has a pH of 7.5 to 12, preferably of 8 to 10. For this purpose inorganic or organic bases, advantageously readily volatile bases such as ammonia, are for example used. Furthermore it is advantageous to use temperatures of at most 80° C. For example 60° to 70° C, in a reaction with (g). When using ammonia or a tertiary amine as the component (g), the reaction is appropriately carried out at room temperature. The resulting solutions or dispersions which are optionally, treated with a base, and advantageously adjusted with an organic solvent or with water to a content of 10 to 40% of reaction product, are distinguished by high stability.

Suitable organic solvents in the presence of which the reaction products are manufactured are, above all, water-soluble organic solvents, and in particular advantageously those which are miscible with water to an unlimited extent. Dioxan, isopropanol, ethanol and methanol, ethylene glycol n-butyl ether (=n-butylglycol) and diethylene glycol monobutyl ether may be mentioned as examples.

It is, moreover, also possible to carry out the reaction in the presence of water-insoluble organic solvents, for example in hydrocarbons, such as petroleum ether, benzene toluene and xylene, or in halogenated hydrocarbons, such as methylene chloride, methylene bromide, chloroform, carbon tetrachloride, ethylene chloride, ethylene bromide, s-tetrachloroethane and above all trichloroethylene.

In adjusting the pH of the samples of a reaction product to 2 to 8 or 7.5 to 12, the sample is diluted with water to the desired concentrations, e.g. from 10 to 40%. The desired pH is then adjusted within the indicated limits by addition of acid.

So-called acrylic resins, e.g. copolymers of acrylic isobutyl ester, acrylonitrile and acrylic acid, are also very suitable binders.

The binders are appropriately used in the form of aqueous solutions or dispersions which, in addition to the reactive surfactant, may contain yet further additives, such as an emulsifying agent or an organic solvent.

The heat treatment which follows on the treatment of the nonwovens with the binder/foaming assistant preparation, consists preferably of a drying and subsequent heating to 60° to 190° C, especially 100° to 150° C. Drying is carried out preferably at room temperature.

Since many binding agents have a relatively low viscosity, the foam which forms can very rapidly decompose again. It is therefore expedient to ensure a high viscosity, which is best done by adding thickeners. The thickeners used are preferably acid-resistant and should effect a considerable increase in the viscosity with as little substance as possible. Cellulose ethers, carubic acid derivatives, polyacrylic esters and, above all, ethyl cellulose, have proved to be very suitable products.

The amounts used depend on the one hand on the viscosity of the binder emulsion, and on the other on the thickening action of the product; as a rule 2 to 30 g/l, preferably 3 to 20 g/l. suffice.

The reactive surfactants are used appropriately in a concentration of 2 to 100 g/l, preferably 5 to 50 g/l, of the treatment bath; whereas the binders are appropriately used in concentrations of 100 to 700 g/l, preferably 170 to 330 g/l, but particularly about 250 g/l.

The preparations which are used according to the invention for setting nonwovens may contain yet further additives in order to attain at the same time other finishing effects, e.g. an antimicrobial effect. Aminoplast precondensates, for example, have proved suitable for this purpose, and it is possible to attain particularly good effects by mixing aminoplast precondensates which contain alkyl ether groups with the condensation products used as binding agents from the components a, b, c and c' and, above all, a, b, $c_1$ and, optionally, $c_2$, and in so doing the amount of these aminoplast precondensates may be about 40 percent by weight or more, relative to the whole mixture, and this mixture is used according to the invention together with the reactive surfactants.

The nonwovens are impregnated with the binder preparations which contain the reactive surfactants by methods which are known in the art, preferably by the padding process. The increase in weight of the thus treated fibre fleece is as a rule 30 to 80%, preferably 40 to 70%.

Practically all conventional textile fibres, and in addition glass fibres, are suitable for the manufacture of the basic fibre fleece. However, nonwovens which contain fibres of polyamide, viscose staple, polyester, polyacrylonitrile or polypropylene, are preferred. Any described blends of the cited fibres may be used as well.

EXAMPLES

Manufacturing Instructions for Reactive Surfactants

I. 126 Parts of melamine, with addition of 18 parts of 25% ammonia, are dissolved at 60° C in 590 parts of 36.5% aqueous formaldehyde containing methanol. The solution is heated to 80° C and 132 parts of a mixture of methanol and water are distilled off in vacuo over the course of about 20 minutes. The residue is then treated with 490 parts of n-butanol and distillation in vacuo is continued, in the course of which the water/n-butanol mixture which passes over is isolated. The n-butanol runs back again into the reaction vessel, while 118 parts of aqueous layer separate out. A solution of 3 parts of 85% formic acid in 5 parts of n-butanol is added and altogether 452 parts of n-butanol are distilled off and carry over the remainder of the water, to give 532 parts of a viscous, colourless resin, which is miscible with benzene in any desired ratio and is hereinafter designated as coating resin A.

Coating resin A (445 parts) is treated with 50 parts of a polyethylene glycol having an average molecular weight of 4000. After heating to 95°–100° C and adding 3 parts of glacial acetic acid heating is continued until a sample of the reaction product dissolves to a clear solution in water. The triethanolamine (70 parts) is added, the mixture stirred and heated for 2 hours to 120° C. The reaction mixture is cooled and a colourless, waxlike substance is obtained which is readily miscible with water at 60° C. A 50%, faintly turbid surfactant solution with a pH of 8.1 to 8.2 is obtained by adding the same amount of water and a small amount of acetic acid. In 5% aqueous solution, this reactive surfactant reduces the surface tension of the water from 72.75 dyn/cm to 41.0 dyn/cm (= reactive surfactant I).

II. 126 Parts of melamine and 600 parts of 30% formaldehyde are heated for about ½ hour at 90° C and pH 8.2 until the initially clear solution starts to become turbid. Then 1000 parts of n-butanol and 8 parts of glacial acetic acid are added and the mixture is heated under reflux until the resin solution has again become clear. Using a descending cooler, butanol and water are distilled off in vacuo until the latter has completely passed over and the distillate runs clear when cold.

Then polyethylene glycol (800 parts) having a molecular weight of 4000 is added and heating is continued in vacuo to 90° C, in the course of which further amounts of butanol and water are distilled off. Heating is continued until a sample of the reaction product dissolves to give an almost clear solution in water. Then triethanolamine (18 parts) is added and the mixture is stirred and cooled. A colourless, wax-like substance which is readily soluble in water is obtained (= reactive surfactant II).

III. 206 Parts of 36.5% aqueous formaldehyde, 170 parts of n-butanol and 60 parts of urea are treated with 8 parts of 25% ammonia and the reaction mixture is heated in an agitator vessel fitted with a descending cooler for 2 hours to 96° C, in the course of which 32 parts of an n-butanol/water mixture are distilled off. The residue is cooled to about 50° C and a solution of 1 part of 85% phosphoric acid in 20 parts of n-butanol is added. The reaction mixture is heated in vacuo to 80° C, in the course of which water and n-butanol are distilled off. The water is isolated from the distillate, while the n-butanol runs back again into the reaction vessel. After 4 hours the product is practically anhydrous and miscible with benzene in any desired ratio. It is then neutralised by adding 5 parts of triethanolamine and concentrated in vacuo to 212 parts, to give the product which is hereinafter designated as coating resin B.

150 Parts of coating resin B are treated in an agitator flask with 100 parts of glycolic butyl ester and 3 parts of glacial acetic acid and the mixture is heated in vacuo to 80°-90° C, in the course of which 63 parts of n-butanol are distilled off in 1½ hours. Then a solution of 40 parts of solid potassium hydroxide in 200 parts of ethyl alcohol is added and the mixture is heated to the boil, in the process of which the initially clear mixture becomes turbid. It is evaporated to dryness in vacuo to give about 185 parts of a colourless, solid substance which dissolves in water to a clear vigorously foaming solution. The aqueous solution has a pH of 8.0 and a substantial emulsifying capacity. If it is acidifed by the addition of acetic acid, a white resin precipitate immediately falls out which is no longer soluble in excess alkali. A similar product is obtained by using an equivalent amount of ethyl actate instead of glycolic butyl ester (= reactive surfactant III).

IV. 206 Parts of 36.5% aqueous formaldehyde are added to 230 parts of 25% ammonia. Upon heating the mixture to 40° C, 60 parts of urea are added and the whole mixture is heated to the boil and 37 parts of a mixture of methanol and water are distilled off. The batch is treated with a mixture of 1 part of 85% phosphoric acid in 20 parts of n-butanol, stirred for 15 minutes and a mixture of water and n-butanol is distilled off in vacuo, in the course of which the former is isolated and the latter is allowed to run back into the reaction vessel. After 134 parts of water with a butanol content have been removed, 87 parts of ethylene glycol and 30 parts of lauryl alcohol are added and 218 parts of n-butanol are distilled off in vacuo, carrying the remainder of the water with them. Condensation is carried out for a further hour at 95°-100° C, then 15 parts of anhydrous sodium bisulphite are added. The reaction product has become slightly water soluble after 30 minutes at 100° C. It is stirred with 8 parts of triethanolamine and the mixture cooled, to give 270 parts of a viscose, clear, resin-like product, which dissolves readily in water to give strongly foaming solutions (= reactive surfactant IV).

V. 126 Parts of melamine with addition of 18 parts of 25% ammonia are dissolved at 60° C in 590 parts of 36.5% aqueous formaldehyde which contains methanol. The solution is heated to 80° C and 132 parts of a mixture of methanol and water are distilled off in vacuo over the course of about 20 minutes. The batch is then treated with 490 parts of n-butanol and distillation is continued in vacuo, in the course of which the water/n-butanol mixture which passes over is isolated. The n-butanol runs back again into the reaction vessel, while 118 parts of aqueous layer separate out. A solution of 3 parts of 85% formic acid in 5 parts of n-butanol is added and then altogether 452 parts of n-butanol are distilled off which carry the remainder of the water with them, giving 532 parts of a viscose, colourless resin which is miscible with benzene in any desired ratio and is designated hereinafter as coating resin C.

While stirring 532 parts of the melamine/n-butanol resin C (containing 1 mole of melamine) are heated with 104 parts of triethanolamine for 1½ hours to 120° C and then for 1½ hours to 135°-140° C, in the course of which 76 parts of n-butanol are distilled off. The batch is cooled, to give 560 parts of a clear, viscose product is readily soluble in 10% acetic acid. Its acid solutions have an excellent emulsifying capacity. The formation of an insoluble resin occurs at pH 4 and slightly elevated temperature. These properties define the product as a reactive surfactant; it has a solids content of 80 to 85%. In 5% aqueous solution this reactive surfactant effects a reduction of the surface tension of water from 72.75 dyn/cm to 37.6 dyn/cm (.reactive surfactant V).

VI. 187 g (2 moles) of monomethylol urea which contains about 7 g of water (manufactured according to Houbon-Weyl, Methodon der organischen Chemie, 4th. edition, Vol. XIV, part 2, page 348) are treated with 900 g of n-butanol and 4 g of glacial acetic acid and the reaction mixture is heated to 100° C until a sample upon cooling, remains clear (this takes a few minutes). Then 334 g of dodecanol (=90% of 2 moles) are added and 880 to 890 g of n-butanol are distilled off in vacuo at 55-80° C within 2 hours. The dodecyl ether which has formed is neutralised with 10 g of triethanolamine and 200 g of ethanol and 200 g of 36.5% formaldehyde (2.4 moles) are added, the batch is stirred for 2 hours at 85° C and the insoluble resin which has formed is filtered off hot. The dimethylol urea monododecyl ether dissolves readily in hot dilute ethanol. Upon cooling, a portion crystallises out and the remainder may be obtained by evaporating the mother liquor.

28.8 g of dimethylol urea monododecyl ether are condensed in vacuo at 20 mm Hg and 90-100° C with 60 g of polyethylene glycol (average molecular weight = 600) in the presence of 1.0 g of glacial acetic acid, in the course of which 2.5 g of water and acetic acid escape. After 1¼ hours the condensation mixture is treated with 2.1 g of triethanolamine and cooled, to give a liquid surfactant which dissolves readily in water to give a foaming solution of pH 7.9 (=reactive surfactant VI).

VII. Monomethylol urea (cf. VI) is etherified with a mixture of higher alkanols containing from 12-15 carbon atoms and having an average molecular weight of 207. The etherification product is reacted with formaldehyde to give a derivative of dimethylol urea. 31 g (app. 1/10 mole) of this dimethylol urea monoalkanol ether is condensed in vacuo at 90°-130° C in the presence of 1 g of glacial acetic acid with 40 g of poylyethylene glycol having an average molecular weight of 400. Altogether 1.6 g of distillate (water and some acetic acid are collected. After neutralisation by adding 2.6 g of triethanolamine and cooling, a liquid-viscose product is obtained which dissolves in water with slight trubidity to give a strongly foaming solution (= reactive surfactant VIIa).

b. A similar product is obtained by condensing the dimethylol urea monoalkanol ether with 30 g of polyethylene glycol having an average molecular weight of 300 (= reactive surfactant VIIb).

VIII. In alcoholic slightly alkaline solution 1 mole of formaldehyde is additively combined with 342 g (1 mole of monomethylol urea stearyl ether (manufactured from the n-butyl ether by transetherification with stearyl alcohol), After the resin which has formed has been filtered off, 340 g of dimethylol urea stearyl ether (M = 373) are obtained. 37.2 g (1/10 mole) of this product are condensed with 154 g of polyethylene glycol ether (having an average molecular weight of 1540) in the presence of 1.0 g of glacial acetic acid for 1½ hours at 90°-100° C in vacuo. The condensation mixture is then treated with 2 g of triethanolamine, and the batch is stirred and cooled. A wax-like substance is obtained which is readily soluble in water to give a slightly turbid solution. Its clearly foaming solution displays a remarkable washing and wetting action. The product is found to be a typical reactive surfactant in that it is possible to totally destroy the surfactant properties (rapidly on heating, slowly at normal temperature) by acidifying. Insoluble resin falls out of the solution, which no longer foams. (Reactive surfactant VIII).

IX. Instead of the stearyl ether mentioned in VIII, the corresponding monomethylol urea oleyl ether is chosen as starting material, converted by addition of 1 mole of formaldehyde into the dimethylol urea derivative and 1 mole thereof is condensed with 1 mole of polyethylene glycol ether (average molecular weight = 1000) in the presence of acetic of formic acid. Nautralisation with morpholine or triethanolamine gives a soft, wax-like product which, like reactive surfactant VIII, is readily soluble in water and possesses the properties of a hardening primary condensate.

X. To a solution of 90 g (¼ mole) of monomethylol urea hydroabiethyl ether (manufactured by transetherifying monomethylol urea butyl ether with hydrobiethyl alcohol) in 500 g of ethanol are added 30 g of 36.5 formaldehyde and sufficient triethanolamine to cause the solution to show a clear alkaline reaction. The solution is stirred for 2 hours at 70° C and evaporated to dryness in vacuo to give 90 g (¼mole) of dimethylol urea monohydroabiethyl ether. This ether is treated with 150 g of polyethylene glycol ether (average molecular weight = 600) and 4 g of glacial acetic acid and condensation is carried out for 1½ hours at 90°-95° C in vacuo, in the process of which 6 g of water and acetic acid collect in the condenser. The liquid-viscose reaction product is then made slightly alkaline again by addition of triethanolamine. It dissolves readily in water to give an opalescent, foaming solution. If this solution is treated with acid until a slightly acid reaction to Congo red is attained, an insoluble resin precipitates (slowly at normal temperature, rapidly on heating), in the process of which the aqueous liquid completely loses its foaming power. (Reactive surfactant X).

Manufacturing Instructions for Binding Agents

A. 196 g (1 epoxide equivalent) of an epoxide formed from 2,2-bis-(4'-hydroxyphenyl)-propane and epichlorohydrin together with 155 g (0.5 amino group equivalent) of a mixture of 1-aminoeicosane and 1-amino-docasane and 181 g of n-butylglycol are stirred for 1 hour at 100° C. The mixture is then cooled to room temperature.

150.5 of the above solution are heated in an agitator flask to 60° C internal temperature. Then 37.2 g of a polyamide from polymeised linoleic acid and diethylene-triamine (0.15 amino group equivalent), dissolved in 16 g of n-butyl-glycol, are added dropwise within 30 minutes. The batch is then stirred for 5 hours at 60° C internal temperature.

Then 3.9 g of 1,3-dichloro-2-propanol (0.03 mole) are added and the mixture is stirred once more for 1 hour at 60° internal temperature. Upon addition of 24 g of glacial acetic acid in 133 g of deionised water, the mixture is stirred until cold.

A solution of medium viscosity, with a solids content of 40% and a pH of 4.8 is obtained (=binding agent A).

B. 98 g (0.5 epoxide equivalent) of an epoxide formed from 2,2-bis(4'-hydroxy-phenyl)-propane and epichlorohydrin together with 77.5 g (0.25 amino group equivalent) of the fatty amine used in Instruction A and 94.5 g of isopropanol are boiled under reflux for 1½ hours.

Then a solution of 247 g of the polyamide described hereinabove (1 amino group equivalent) in 328 g of isoporpanol is added dropwise within 1 hour. Then stirring is continued for 5 hours at reflux temperature.

53.5 g of acrylic amide (0.75 mole) and 22.5 g of paraformaldehyde (0.75 mole) are then added and stirring is continued again for 8 hours at reflux temperature.

The batch is subsequently diluted with a solution of 60 g of glacial acetic acid in 1500 g of deonised water. A solution of low viscosity, which a solids content of 20% and a pH of 4.6, is obtained (=binding agent B).

C. 98 g (0.5 epoxide equivalent) of an epoxide formed from 2,2-bis-(4'-hydroxyphenyl)-propane and epichlorohydrin together with 31 g of a mixture of 1-aminoeicosane and 1-aminodocosane (0.1 amino equivalent) and 55.5 g of butylglycol are stirred for 3 hours at 100° C internal temperature. Then 17.7 g of hexane-diol-1,6 and 25.5 g of sebacic acid are added and stirring is continued for 3 hours at 100° C internal temperature. 10.2 g (0.1 mole) of methylolacrylic amide are then added and stirring is continued once more for 3 hours at 100° C internal temperature. Upon addition of 146.9 g of butylglycol, stirring is continued until the mixture is cold.

A clear solution of low viscosity with an acid number of 6 is obtained (= binding agent C).

D 98 g (0.5 epoxide group equivalent) of an epoxide formed from 2,2-bis-(4'-hydroxyphenyl)-propane and epichlorohydrin together with 31 g (0.1 amino group equivalent) of a mixture of 1-amino-eicosane and 1-amino docosane and 50 g of n-butylglycol are stirred for 3 hours at 100° C internal temperature. Then 17.7 g of hexane-diol-1,6 (0.3 hydroxyl group equivalent) and 50.5 g of sebacic acid (0.5 acid group equivalent) are added and stirring is continued for 3 hours at 100° C internal temperature. Upon addition of 4.6 g of epichlorohydrin (0.05 mole), stirring is continued for a further 3 hours at 100° C internal temperature and the batch is subsequently diluted with 151.8 g of n-butylglycol. Stirring is continued until the mixture is cold. A clear product of low viscosity with an acid number of 43.6 is obtained (binding agent D).

E. While stirring thoroughly, a solution of 49.4 g of a condensation product (amino equivalent weight = 247) of polymerised linoleic acid and diethylenetriamine and 49.4 g of methanol is added within 24 minutes to a solution heated to 51° C of 38.4 g of an epoxide (epoxide equivalent weight =191) formed from 2,2-bis(4'-hydroxyphenyl)-propane and epichlorohydrin and 38.4 g of methanol, in the course of which the reaction temperature is 51° to 53° C. After 8 and 18 minutes 3 g of glacial acetic acid are added on each occasion and after 24 minutes a further 2 g of glacial acetic acid are added. The reaction is continued for a further 2 hours and for 35 minutes at 55° to 60° C. The reaction product is then soluble in water to give an opalescent solution. While stirring, 4 g of glacial acetic acid and 273.4 g of water are added. A yellowish, viscous, turbid 20% solution with a pH of 5.2 is obtained.

F. 68.5 g (0.1 epoxide group equivalent) of an epoxide (epoxide equivalent weight = 685) obtained from 196 g (1 epoxide group equivalent) of 2,2-bis-(4'-hydroxyphenyl)-propane and epichlorohydrin as well as 155 g (0.5 amino group equivalent) of an amino mixture of 1-amino-eicosane and 1-amino-docosane are dissolved in 37 g of isopropanol and the solution is heated to 88° C internal temperature. Then a solution of 24.7 g (0.1 amino group equivalent) of a polyamide of polymerised linoleic acid and diethylene-triamine in 24.7 g of isopropanol and 15 g of isopropanol is added within 30 minutes.

The mixture is stirred for 5 hours at 88° C internal temperature under reflux and then 1.85 g of epichlorohydrin (0.02 mole) are added. After a further 10 minutes a solution of 16 g of glacial acetic acid and 312 g of deionized water is added and stirring is continued until the mixture is cold. A product of low viscosity with a solids content of 20% and a pH of 4.6 is obtained.

G. 98 g of an epoxide (0.5 epoxide group equivalent) from 2,2-bis-(4'-hydroxyphenyl)-propane and epichlorohydrin together with 31 g (0.1 amino group equivalent) of a mixture of 1-amino eicosane and 1-amino docosane and 50 g of butylglycol are stirred for 3 hours at 100° C. Then 15.6 g of neopentylglycol (0.3 hydroxyl group equivalent) and 50.5 g of sebacic acid (0.5 acid group equivalent) are added and stirring is continued for 3 hours at 100° C. 13.9 g of epichlorohydrin (0.15 mole) are then added and stirring is again continued for 3 hours at 100° C internal temperature.

Subsequently the mixture is diluted with 159 g of perchloroethylene and stirred until cold. A clear solution of medium viscosity and with an acid number of 20 is obtained.

100 g of this 50% resin solution are then mixed with 62.5 g of an 80% solution of hexamethylolmelamine-di- and tributyl ether in butanol.

To this mixture are added 10 g of a 50% solution of an addition product of 70 moles of ethylene oxide with a fatty amine mixture ($C_{16}$–$C_{22}$) and the whole mixture is emulsified. A finely disperse emulsion with a resin content of 30% is obtained by slowly adding water.

b. Instead of the mixture described under (a) it is also possible to react the epoxide resin with the hexamethylolmelamine di-and tributyl ether, the procedure being as follows:

100 g of the 50% resin solution are mixed with 62.5 g of an 80% solution of hexamethylolmelamine di-and tributyl ether in butanol and the batch is reacted for 1 hour at 100° internal temperature. The reaction mixture is then diluted with 37.5 g of perchloroethylene and a clear solution of medium viscosity and with a resin content of 50% is obtained. 100 g of resin solution are emulsified with a 50% solution of an addition product of 70 moles of ethylene oxide with a fatty amine mixture ($C_{16-C22}$). A finely disperse emulsion with a resin content of 30% is obtained by slowly adding 56.5 g of deionized water.

EXAMPLE 1

30 liters of water are put into a vessel and then 2000 g of reactive surfactant I and 200 g of an aqueous 2% ethyl cellulose solution as thickener are added. This mixture is stirred until the thickener has become completely dispersed. Then 25000 g of binder A are added and thereupon the pH is adjusted to 3 with formic acid while stirring constantly. The liquor is then made up to 100 liters with water. The stirring apparatus is then so adjusted that a funnel is formed when the liquor is stirred.

This special arrangement of the agitator enables as much air as possible to be brought into the system. Stirring is proceeded with until the volume of the liquor has risen to 200 liters. A polyester fleece is impregnated with this foam in a horizontal 2 roll padder. The increase in weight is 50 to 60%. After the fleece has been removed from the padder it is dried at 140° C for 10 minutes and cured. In the course of this drying operation the reactive surfactant decomposes and loses its wetting action. A permanently reinforced nonwoven is obtained.

EXAMPLE 2

The same procedure is carried out as in Example 1, but binder B is substituted for binder A. A permanently reinforced nonwoven is likewise obtained.

EXAMPLE 3

The same procedure is carried out as in Example 1, but reactive surfactant I is substituted for reactive surfactant II and a permanently reinforced nonwoven is likewise obtained.

EXAMPLE 4

70 liters of cold water are put into a preparing vessel (room temperature) and 20 g of binder C are added. Then 1000 g of a 2% aqueous ethyl cellulose solution are added. The mixture is then stirred with an impeller in order to uniformly disperse the thickener, and 5000 g of reactive surfactant III are added.

The pH is adjusted with formic acid to 3 and the liquor is made up to 100 liters with water. The agitator is so adjusted that as much air as possible is stirred in. In addition, air is also bubbled in through jets which are as fine as possible. The liquor is stirred until its volume has increased from 100 to 200 liters. A polyester fleece, which may be prereinforced by needles, is then impregnated with this foam liquor on a horizontal 2 roll padder or on a special screen-belt impregnating machine to an increase in weight of 50 to 70%. The fleece is subsequently dried and cured at 140° C for 5 minutes. During this curing the reactive surfactant loses its wetting action. A permanently reinforced nonwoven is obtained.

The wettability of fibre fleece:

The wetting time indicated hereinbelow are determined as follows:

A round sample with a diameter of 4 cm is punched out and dipped on a fish hook in water having a temperature of 20° C. The time is measured between dipping and sinking of the sample:

| Treatment | Drying temperature in ° C | Wetting Times |
|---|---|---|
| natural state | 140° | immediately |
| binder only | 140° C | over 10 mins. |
| binder + reactive surfactant | 20° | immediately |
| binder + reactive surfactant | 100° C | immediately |
| binder + reactive surfactant | 120° C | immediately |
| binder + reactives surfactant | 140° C | over 10 mins. |

EXAMPLE 5

The procedure is carried out as in Example 4, but reactive surfactant IV is substituted for reactive surfactant III. Permanently reinforced nonwovens are likewise obtained.

EXAMPLE 6

The procedure is carried out as in Example 4, but 1000 g of magnesium chloride are substituted for the formic acid. Permanently reinforced nonwovens are likewise obtained.

EXAMPLE 7

The procedure is carried out as in Example 4, but binder D is substituted for binder C. Permanently reinforced nonwovens are likewise obtained.

EXAMPLE 8

A nonwoven consisting of viscose staple fibre is impregnated with the following foamed liquor:

200 g of binder E
170 g of water
90 g of hydroxyethy cellulose (2.5%)
6 g of reactive surfactant V
50 g of acetic acid (40%).

The batch is adjusted with formic acid to pH 3.6. This liquor is then foamed to twice its volume with an impeller and by bubbling in air. The impregnation is effected on a padder and the roller pressure is so adjusted that there is an increase in weight of the goods of 40–50%. The fabric is subsequently dried for 10 minutes at 110° C. The reactive surfactant decomposes as a result of the drying and loses its wetting action which is important for the padding and its foaming capacity.

An aftertreatment is thereby rendered superfluous. Similar results are also obtained with polyester and polypropylene fibre fleece.

EXAMPLE 9

The following foamed liquor is applied by padding to a viscose staple fibre fleece:

200 g of a 50% aqueous emulsion of an acrylic resin binder, prepared by compolymerisation of the following monomers:
85 parts of n-butylacrylate
10 parts of acrylonitrile
5 parts of acrylic acid
4 g of reactive surfactant VII
50 g of water
40 g of carboxymethylcellulose (2.5%)
10 ml of Mg $Cl_2$ (20%).

This liquor is adjusted with formic acid to pH 3, and subsequently foamed by stirring and bubbling in air. The fleece is padded to an increase in weight of 30–60%. It is then dried for 10 minutes at 140° C. The hydrophilic action of the reactive surfactant is neutralised after the drying.

Instead of reactive surfactant VII is is also possible to use reactive surfactant X.

Instead of carboxymethylcellulose it is also possible to use methyl cellulose, methoxycellulose or polyacrylic ester.

Instead of a nonwoven of viscose staple, it is also possible to use one of polyamide or polyester fibre material.

EXAMPLE 10

A polyester fleece which has been prereinforced by needling is padded with the following preparation:

200 g of binder F
4 g of reactive surfactant VI
50 g of 5% aqueous carob bean meal thickening
80 g of water.

The batch is adjusted with formic acid to pH 3. The liquor is foamed by stirring and bubbling in air. The fabric is padded to an increase in weight of 40–60%. The material is padded to an increse of 40–60%. The reactive surfactant loses its hydrophilic action in the drying process.

Instead of reactive surfactant VI it is also possible to use reactive surfactant VIII.

Instead of polyester fleece it is also possible to use polyamide/polypropylene or viscose stable fibre fleece.

It is also possible to use blends of these fibres. Besides blends of the cited fibres it is also possible to use further fibres, e.g. polyacrylonitrile fibres.

EXAMPLE 11

A polyamide needle fleece carpet is padded with the following foamed liquor:

200 g of binder G a)
3 g of reactive surfactant IX
40 g of methyl cellulose (5%)
150 g of water
10 ml of $MgCl_2$ (20%)
50 g of butylglycol.

The pH is adjusted with formic acid to 2.8. The liquor is foamed to twice its volume by stirring and bubbling in air. The material is padded to an increase in weight of 40–60%. It is then dried at 90° C. During the drying the reactive surfactant loses its wetting action, so that an aftertreatment is superfluous.

Instead of binder (G a) is is also possible to use a 50% butadiene/styrene/latex dispersion.

We claim:

1. A process for reinforcing nonwoven fiber material by a foaming process, comprising the steps of A. impregnating the nonwoven fiber material with an aqueous preparation containing a water-soluble or water-dispersible binding agent and a foaming assistant, wherein the binding agent is a reaction product obtained by reacting, in the presence of an organic solvent, a. an epoxide which contains at least 2 epoxide groups per molecule, b. a fatty amine having 12 to 22 carbon atoms, and $c_1$. an aliphatic, saturated dicarboxylic acid containing 7 to 14 carbon atoms, and wherein the foaming assistant is a reactive surfactant which is convertable into the irreversibly insoluble state at elevated temperature and thereby loses its surface activity, the foaming assistant being a surface active methylolmelamine or methylolurea having methylol groups etherified with a monoalcohol of 4 to 22 carbon atoms and at least one member of the group consisting of an alkanolamine of 2 to 6 carbon atoms, a polyethyleneglycol having an average molecular weight of 1000 to 5000, an alkanol of the formula $H-(OCH_2CH_2)_m-OH$ where $m$ is 1 to 25 and which contains an alkali metal sulfonate group bonded to carbon and an aliphatic-hydroxy-carboxylic acid containing 2 to 4 carbon atoms, and B. subsequently heating the impregnated non-woven fiber material at 60° to 190° C to convert the foaming assistant to an irreversibly insoluble state and to destroy the surface activity of the foaming assistant.

2. The process of claim 1, wherein the reactive surfactant is methylolurea or methylolmelamine having methylol groups etherified with an alkanol which contains 4 to 22 carbon atoms, a saturated hydroxyalkane-carboxylic acid which contains from 2 to 4 carbon atoms, and a member selected from the group consisting of ethanolamine, diethanolamine and triethanolamine.

3. The process of claim 1, wherein the reactive surfactant is methylolmelamine whose methylol groups are etherified with an alkanol which contains 4 to 18 carbon atoms, and with a member selected from the group consisting of ethanolamine, diethanolamine and triethanolamine.

4. The process of claim 1, wherein the heat treatment is carried out at 90° to 150° C.

5. The process of claim 1 wherein the binder/foaming assistant preparation also contains a thickening agent as additive.

6. The process of claim 5, wherein nonwoven fiber material of glass or textile fibers is used.

7. The process of claim 6, wherein nonwoven fiber material which contains fibers of polyamide, viscose staple, polyester, polyacrylonitrile or polypropylene, are reinforced.

8. The process of claim 1, wherein the binding agent is a condensation product of components (a), (b) and ($c_1$) in admixture with an aminoplast precondensate which contains alkyl ether groups.

9. The process of claim 1, wherein the component (a) is an epoxide which is derived from a bisphenol.

10. The process of claim 9, wherein the component (a) is a polyglycidyl ether of 2,2-bis-(4'-hydroxyphenyl)-propane.

11. The process of claim 10, wherein the component (a) has an epoxide contant of at least 5 epoxide equivalents per kg.

12. The process of claim 10, wherein the component (a) is a reaction product of epichlorohydrin with 2,2-bis-(4'-hydroxyphenyl)-propane.

13. The process of claim 1, wherein the binding agent is a reaction product obtained by reacting components (a), (b), ($c_1$) and additionally, one or more of the following components:

d. an aminoplast precondensate which contains a $C_1$ to $C_4$ alkyl ether group, e. an aliphatic diol containing from 2 to 22 carbon atoms, and f. a difunctional compound selected from the group consisting of epichlorohydrin, glycerine-dichlorohydrin, acrylic acid, acrylonitrile and methylolacrylamide.

14. The process of claim 13, wherein the binding agent is a reaction product obtained by reacting components (a), (b), ($c_1$), (d), (e) and (f).

15. The process of claim 14, wherein component (d) is a hexamethylolmelamine di- and tri-butylether, component (e) is neopentylglycol, and component (f) is epichlorohydrin.

16. The process of claim 13, wherein the component (e) is an alkylene diol containing from 2 to 6 carbon atoms, diethylene glycol or triethylene glycol.

17. The process of claim 1, wherein the binding agent is a reaction product obtained by reacting components (a), (b), ($c_1$) and ($c_2$) which is an anhydride of an aromatic dicarboxylic acid of 8 to 12 carbon atoms or anhydride of an aliphatic di- or monocarboxylic acid of 4 to 10 carbon atoms, in admixture with an aminoplast precondensate which contains alkyl ether groups.

18. The process of claim 1, wherein the binding agent is a reaction product obtained by reacting components (a), (b), ($c_1$) and additionally ($c_2$), wherein component ($c_2$) is an anhydride selected from the group consisting of an anhydride of an aromatic dicarboxylic acid of 8 to 12 carbon atoms, an anhydride of an aliphatic dicarboxylic acid of 4 to 10 carbon atoms, and an anhydride of a monocarboxylic acid containing at least 4 carbon atoms, and additionally one or more of the following components:

d. an aminoplast precondensate which contains $C_1$ to $C_4$ alkyl ether group, c. an aliphatic diol containing from 2 to 22 carbon atoms, and f. a difunctional compound selected from the group consisting of epichlorohydrin, glycerine-dichlorohydrin, acrylic acid acrylonitrile and methylolacrylamide.

19. The process of claim 1, wherein the binding agent is a reaction product obtained by reacting components (a), (b), ($c_1$) and additionally ($c_2$) wherein component ($c_2$) is selected from the group of anhydrides consisting of an anhydride of an aromatic dicarboxylic acid containing 8 to 12 carbon atoms, an anhydride of an aliphatic dicarboxylic acid of 4 to 10 carbon atoms, and an anhydride of a monocarboxylic acid containing at least 4 carbon atoms.

* * * * *